US010618607B2

(12) United States Patent
Milligan

(10) Patent No.: US 10,618,607 B2
(45) Date of Patent: Apr. 14, 2020

(54) LIFEBOAT LAUNCH CONTROL SYSTEM

(71) Applicant: John Milligan, Houston, TX (US)

(72) Inventor: John Milligan, Houston, TX (US)

( * ) Notice: Subject to any disclaimer, the term of this patent is extended or adjusted under 35 U.S.C. 154(b) by 0 days.

(21) Appl. No.: 16/191,957

(22) Filed: Nov. 15, 2018

(65) Prior Publication Data

US 2019/0144079 A1 May 16, 2019

Related U.S. Application Data

(60) Provisional application No. 62/586,750, filed on Nov. 15, 2017.

(51) Int. Cl.

| | |
|---|---|
| ***B63B 23/32*** | (2006.01) |
| ***B63B 23/48*** | (2006.01) |
| ***B63B 23/34*** | (2006.01) |
| ***B63B 23/02*** | (2006.01) |
| ***B63B 23/06*** | (2006.01) |

(52) U.S. Cl.

CPC ..... *B63B 23/32* (2013.01); *B63B 23/02* (2013.01); *B63B 23/06* (2013.01); *B63B 23/34* (2013.01); *B63B 23/48* (2013.01)

(58) Field of Classification Search

CPC ..... B63B 23/32; B63B 23/02; B63B 23/34; B63B 23/48

See application file for complete search history.

(56) References Cited

U.S. PATENT DOCUMENTS

| | | | | | |
|---|---|---|---|---|---|
| 2,091,327 | A * | 8/1937 | McPartland | B63B 23/32 | 114/366 |
| 4,633,802 | A * | 1/1987 | Olsen | B63C 9/22 | 114/367 |
| 5,090,842 | A * | 2/1992 | Montgomery | B63C 3/06 | 114/44 |
| 5,140,923 | A * | 8/1992 | Wood | B63C 3/06 | 114/48 |
| 5,331,913 | A * | 7/1994 | Tanaka | B63B 23/26 | 114/259 |
| 5,619,951 | A * | 4/1997 | Constantinis | B63C 9/22 | 114/365 |
| 5,765,500 | A * | 6/1998 | Nordb.o slashed. | A62B 1/20 | 114/365 |
| 6,152,065 | A * | 11/2000 | Gronstrand | B63B 23/30 | 114/365 |
| 6,672,242 | B2 * | 1/2004 | Webb | B63B 23/10 | 114/365 |
| 6,869,326 | B2 * | 3/2005 | Richard | B65D 21/0223 | 441/42 |
| 7,438,016 | B2 * | 10/2008 | Dronne | B63C 9/22 | 114/365 |
| 7,681,515 | B1 * | 3/2010 | Apple | B63C 9/22 | 114/365 |

(Continued)

*Primary Examiner* — S. Joseph Morano
*Assistant Examiner* — Jovon E Hayes
(74) *Attorney, Agent, or Firm* — Boudwin Intellectual Property; Daniel Boudwin

(57) ABSTRACT

A lifeboat launch control system. The lifeboat launch control system has a wheel trunk that runs along the side of a ship. An axle box is vertically movable in the wheel trunk. The axle box has a pair of wheels on opposing sides of a bar. A shaft is removably inserted into the bar. The shaft is removable from the bar by a handle. When the shaft is removed from the bar, the lifeboat is released from the ship.

10 Claims, 4 Drawing Sheets

(56) References Cited

U.S. PATENT DOCUMENTS

| | | | | |
|---|---|---|---|---|
| 9,533,739 | B2 * | 1/2017 | Ibsen | B63C 9/22 |
| 2007/0006790 | A1 * | 1/2007 | Dronne | B63C 9/22<br>114/365 |
| 2013/0008367 | A1 * | 1/2013 | Michaud | B63C 9/22<br>114/365 |
| 2019/0144079 | A1 * | 5/2019 | Milligan | B63B 23/32<br>114/365 |

* cited by examiner

LIFEBOAT LAUNCH CONTROL SYSTEM

CROSS REFERENCE TO RELATED APPLICATIONS

This application claims the benefit of U.S. Provisional Application No. 62/586,750 filed on Nov. 15, 2017. The above identified patent application is herein incorporated by reference in its entirety to provide continuity of disclosure.

BACKGROUND OF THE INVENTION

The present invention relates to a lifeboat launch control system configured to lower a lifeboat from a larger vessel into a body of water. More specifically, the present invention provides an interface for a ship and lifeboat that provides for safe and efficient lowering of a lifeboat. A wheel trunk is disposed in a hull of a ship and is configured to allow an axle box to pass through. The axle box is operably connected to a shaft which can be actuated by an individual in a lifeboat to release the lifeboat from the axle box.

Typically, ships include at least one lifeboat for use in case of emergencies. Some ships may house additional smaller watercrafts for various purposes. If an emergency occurs or if a smaller watercraft is to be released into the body of water, a cable system is typically used to lower the craft into the water. However, cable systems can provide problems due to the pendulum effect induced by the tide of the water. This danger is particularly notable where seas are rough due to their geographic location or due to severe weather. The aforementioned pendulum effect can create problems for a ship crew in that the smaller craft or lifeboat can be damaged or lost due to the swinging. Additionally, damage can be done to the ship itself if sufficient contact is made with the smaller craft. In addition to the costs associated with repairing such damage, swinging lifeboats and small watercraft can cause injuries to passengers or crew aboard both the larger and smaller watercrafts.

Due to the need to increase safety in the process of lowering lifeboats or small watercraft into a body of water, and the inefficiency of currently available lifeboat lowering systems, there is a defined need in the known art for a lifeboat lowering system that provides increased control to the user thereof.

SUMMARY OF THE INVENTION

In view of the foregoing disadvantages inherent in the known types of lifeboat lowering systems now present in the prior art, the present invention provides a lifeboat launch control systems wherein the same can be utilized for providing convenience for the user when controlling the descent of a lifeboat into a body of water.

The present system comprises a wheel trunk. The wheel trunk is disposed in the hull of a ship. An axle box is disposed in the wheel trunk. The axle box has a bar with a pair of wheels disposed on a pair of opposite sides of the bar. A shaft extends through an aperture disposed in the bar and outward from the wheel trunk. The shaft has a first end and a second end, wherein a lifeboat interface is disposed therebetween. A pin is disposed in the end of the shaft. The aperture in the bar is shaped such that when the shaft is oriented to place the pin into a targeted position, the shaft can be freely moved through the bar. A handle is disposed on the second end of the shaft.

BRIEF DESCRIPTION OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

DETAILED DESCRIPTION OF THE INVENTION

Figure 1:
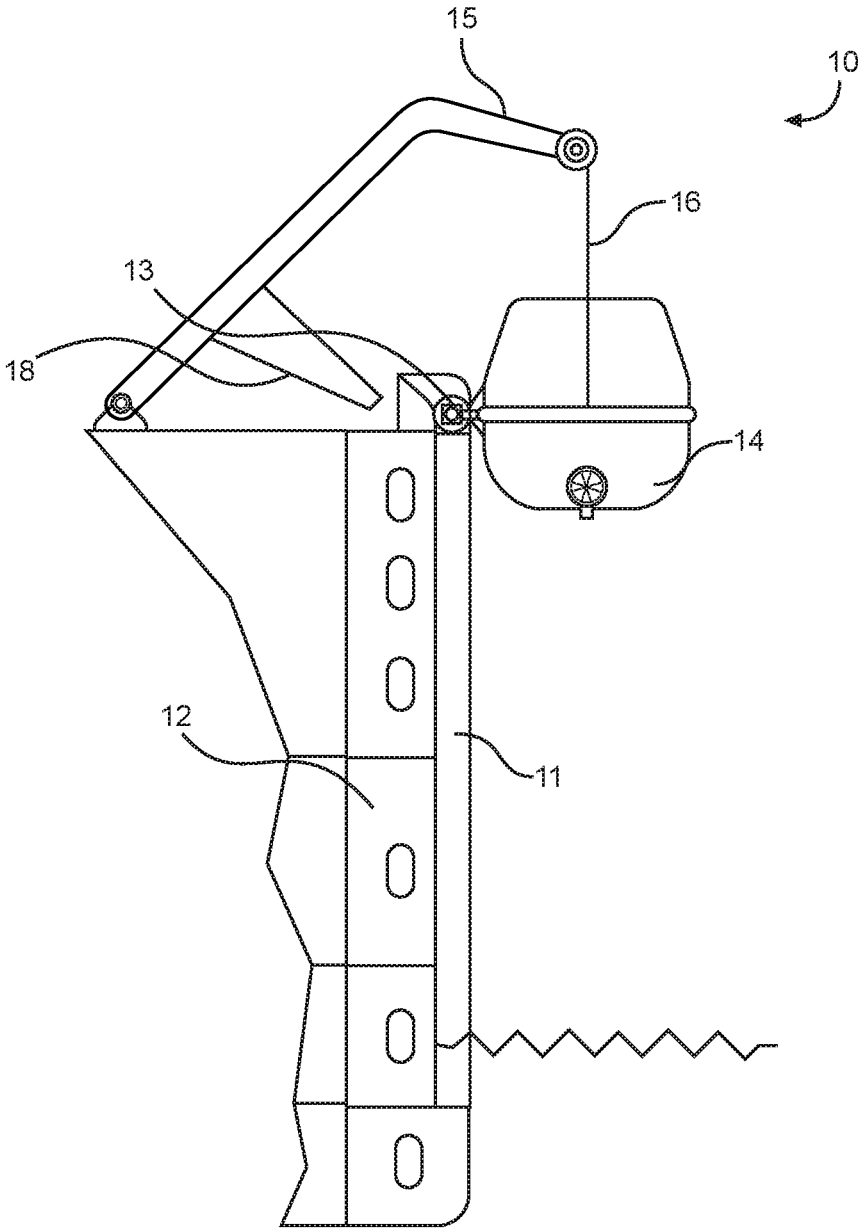
FIG. 1 shows a perspective view of an embodiment of the lifeboat launch control system.

Reference is made herein to the attached drawings. Like reference numerals are used throughout the drawings to depict like or similar elements of the lifeboat launch control system. The figures are intended for representative purposes only and should not be considered to be limiting in any respect.

Referring now to FIG. 1, there is shown a perspective view of an embodiment of the lifeboat launch control system. The lifeboat launch control system 10 comprises a wheel trunk 11 disposed in a hull of a ship 12. In the illustrated embodiment, the wheel trunk 11 comprises three sidewalls and an open slot. The three sidewalls are planar and flat, such that a wheel can pass smoothly in an upward vertical direction and a downward vertical direction. An axle box 13 is disposed in the wheel trunk 11. The axle box 13 is configured to attach to a lifeboat 14. The axle box 13 attaches to the lifeboat 14 using a lifeboat interface. With the axle box 13 locked onto the lifeboat 14, the lifeboat 14 can be raised and lowered under control of the user.

In one embodiment, the lifeboat launch control system 10 further comprises at least one davit 15. As shown, the davit 15 comprises a base disposed on the deck of a boat and an arm extending towards the hull of the ship 12. In the illustrated embodiment, the davit 15 is hinged such that the arm can adjustably extend over the hull of the ship 12. The davit 15 includes an operably connected cable 16. The cable 16 is configured to attach to the lifeboat 14, such that the vertical position of the lifeboat relative to the ship 12 can be manipulated. In one embodiment, the cable 16 is operably connected to a winch, such that the cable 16 can be raised or lowered via actuation of the winch. The winch can be any automatic winch or manual winch. In a further embodiment, the davit 15 comprises a bottom support arm 17 extending therefrom. The bottom support arm 17 is configured to provide additional support to the lifeboat 14 when the lifeboat 14 is stored upon the deck of the ship 12. The stored position is defined in any configuration where the lifeboat 14 cannot be raised or lowered off the hull of the ship 12.

Figure 2:
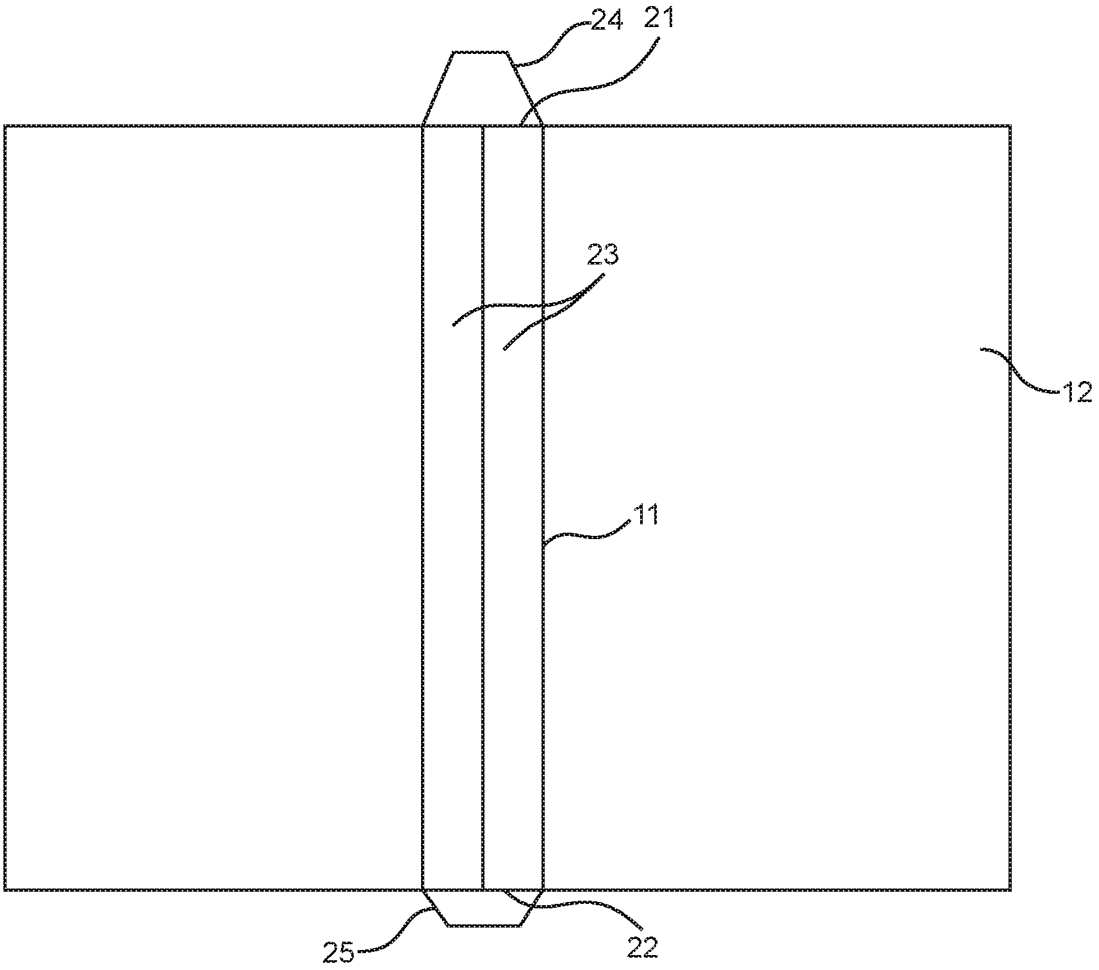
FIG. 2 shows a perspective view of a wheel trunk of an embodiment of the lifeboat launch control system.

Referring now to FIG. 2, there is shown a perspective view of a wheel trunk of an embodiment of the lifeboat launch control system. The wheel trunk 11 has a top end 21 disposed at the top of the hull of the ship 12, and a bottom end 22 disposed at the base of the hull of the ship 12. In the illustrated configuration, the wheel trunk 11 extends linearly down the entire length of the hull of the ship 12. In other embodiments, the wheel trunk 11 is dimensioned to extend to the waterline, where the water meets the hull of the ship 12, such that the lifeboat is released precisely at water level.

In one embodiment, the wheel trunk 11 comprises a pair of flexible flaps 23 disposed on a pair of opposing sides of the wheel trunk 11. The pair of flexible flaps 23 are configured to prevent water from entering the wheel trunk 11 and potentially interfering with the operation of the axle box in the wheel trunk 11. In a further embodiment, the pair of flexible flaps 23 is made of neoprene rubber. In another embodiment, the pair of flexible flaps 23 are each hollow, such as to increase the overall flexibility of the flexible flaps 23.

In another embodiment, the wheel trunk 11 comprises a cover 24 movably disposed on the top end 21 of the wheel trunk 11. The cover 24 is configured to prevent water and debris from entering the wheel trunk 11 from the top end 21 thereof. The cover 24 comprises a door dimensioned to receive the axle box therein. The door is disposed on the side of the cover 24 facing the body of water, such that the lifeboat interface can access the door of the cover 24.

In a further embodiment, the wheel trunk 11 comprises a drain 25 disposed at the bottom end 22 of the wheel trunk 11. The drain 25 is configured to allow water to exit from the bottom end 22 of the wheel trunk 11. In one embodiment, the drain 25 further comprises a pump configured to remove water from the wheel trunk 11.

In another embodiment, the interior surfaces of the wheel trunk 11 are coated in an anti-fouling paint. The anti-fouling paint is configured to slow the growth of subaquatic organisms, such as barnacles and weeds, and to facilitate detachment of the subaquatic organisms from the interior of the wheel trunk 11. The anti-fouling paint is further configured to prevent corrosion and improve the flow of water. In one embodiment, the anti-fouling paint is disposed on an entirety of the wheel trunk 11. In another embodiment, the anti-fouling paint is disposed on at least one desired section of the wheel trunk 11.

Figure 3:
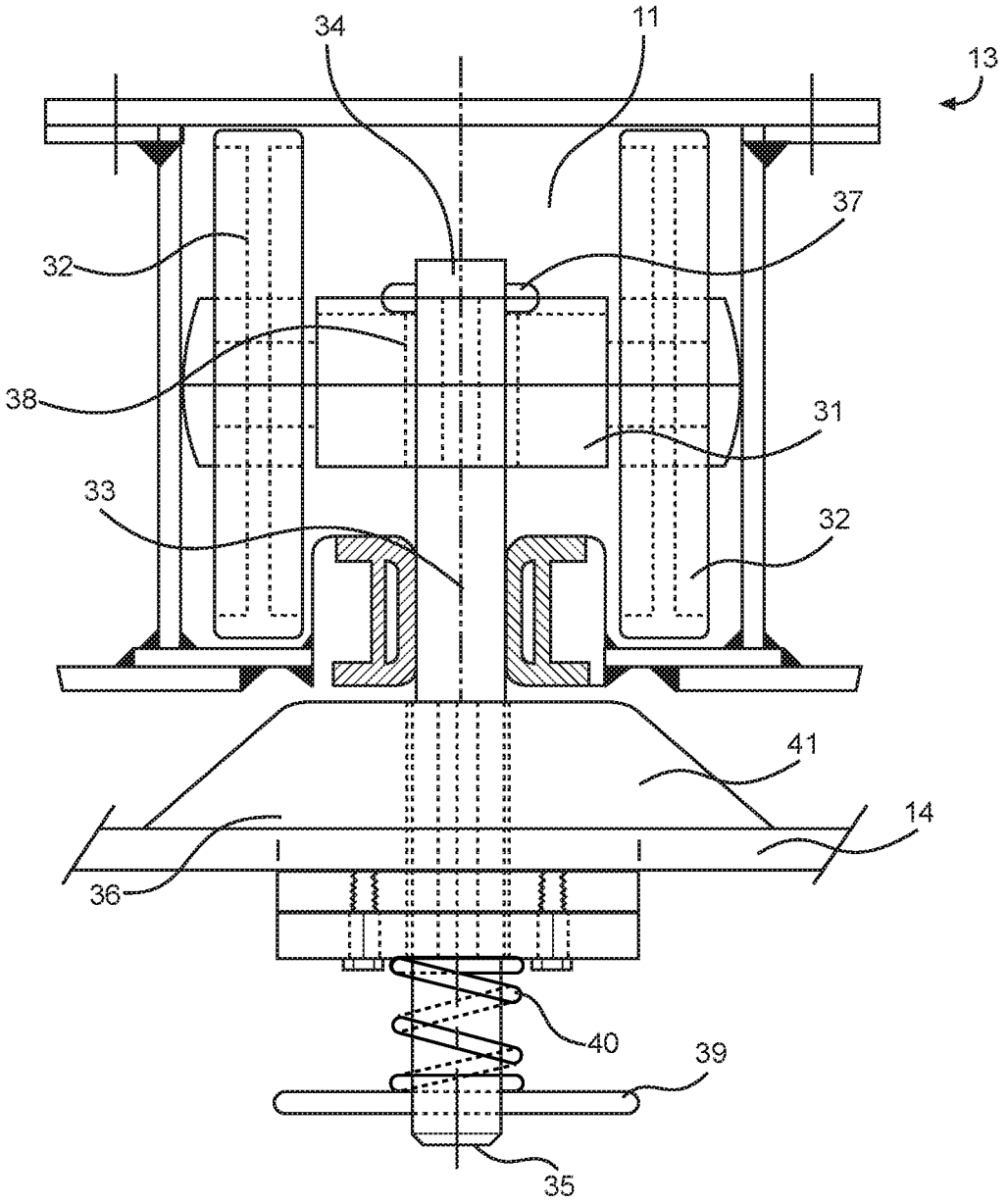
FIG. 3 shows a close-up view of the axle box and the shaft of an embodiment of the lifeboat launch control system.

Referring now to FIG. 3, there is shown a close-up view of the axle box and the shaft of an embodiment of the lifeboat launch control system. The axle box 13 comprises a bar 31 with a pair of wheels 32 rotatably disposed on a pair of opposing ends of the bar 31. The pair of wheels 32 are configured to freely roll along the wheel trunk 11. The bar 31 acts as an axle for the pair of wheels 32. The bar 31 is made of any rigid and durable material, such as to enhance structural stability and to prevent damage to the bar 31. In one embodiment, the pair of wheels 32 are each made of polyurethane. In another embodiment, the pair of wheels 32 are secured to the bar 31 by a fastener, such as an allen socket button head screw.

A shaft 33 extends outward through a slot defined by the wheel trunk 11. The shaft has a first end 34 disposed oppositely the second end 35. The shaft is made of any rigid and durable material such as to enhance structural stability and to prevent damage to the bar 31. The shaft 33 extends through an aperture 38 in the bar 31. The aperture 38 is sized to receive the shaft 33 therethrough. Additionally, the aperture 38 comprises a smooth interior surface such as to reduce friction with the shaft 33.

A lifeboat interface 36 is disposed between the first end 34 and the second end 35 of the shaft 33, such that the first end 34 of the shaft 33 extends into the axle box 13 and the second end 35 of the shaft 33 is accessible from the lifeboat. The lifeboat interface 36 is disposed on a sidewall of a hull of a lifeboat 14. The lifeboat interface 36 is the portion of the lifeboat launch control system between the lifeboat 14 and the axle box 13. In one embodiment, the lifeboat 14 is any lifeboat that is modified to interact with the lifeboat launch control system.

A pin 37 is disposed through the first end 34 of the shaft 33. The aperture 38 is dimensioned such that when the shaft 33 is oriented to place the pin 37 into a targeted position, the shaft can be freely moved through the bar 31. When the pin 37 is placed into the targeted position, and the shaft is pulled out, separation is created between the lifeboat interface 36 and the axle box 13. This action is engaged by an individual in the lifeboat 14 when the lifeboat is in the water and the lifeboat is to be released from the lifeboat launch control system.

A handle 39 is disposed on the second end 35 of the shaft 33. The handle 39 is configured to enable easier and more effective manipulation of the shaft 33 by the individual in the lifeboat 14. In the illustrated embodiment, the handle 39 is a unitary elongated rod perpendicularly attached to the shaft 33. In another embodiment, the handle 39 is rubberized, such as to enable easier grip by the user.

In the illustrated embodiment, a spring 40 is disposed between the lifeboat interface 36 and the handle 39. The spring 40 is tensioned to expand outwardly pulling the shaft 33 and the pin 37 through the aperture 38 when the pin 37 is placed into the targeted position. The spring 40 is configured to assist the user in removing the shaft 33 from the axle box 13 by applying outward pressure that pushes the handle 39 away from the lifeboat interface 36 when the pin 37 is placed into a targeted position.

In another embodiment, the lifeboat interface 36 comprises a bumper 41 disposed on an external surface thereof. The bumper 41 is configured to prevent structural damage to the lifeboat 14 in the event that choppy tides cause the lifeboat 14 to make contact with the hull of the ship 12 after the lifeboat 14 is released from the lifeboat launch control system. The bumper 41 is made of any suitable impact-resistant material, such as rubber.

Figure 4:
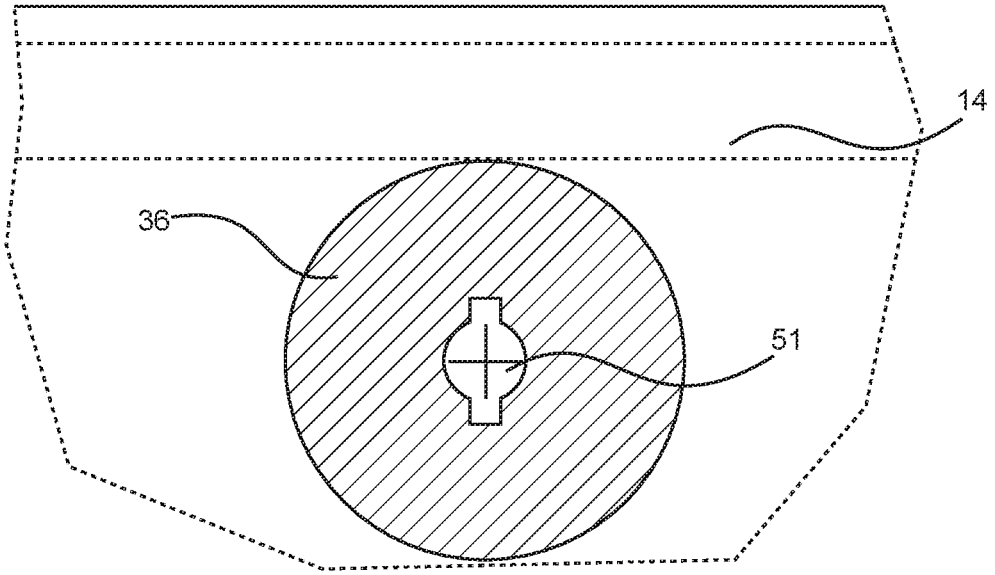
FIG. 4 shows a close-up view of the interface of an embodiment of the lifeboat launch control system.

Referring now to FIG. 4, there is shown a close-up view of the interface of an embodiment of the lifeboat launch control system. As shown, the aperture 51 of the lifeboat interface 36 is dimensioned such that when the shaft is oriented to place the pin into a targeted position, the shaft can be freely moved through the lifeboat interface 36. The aperture of the lifeboat interface 36 is dimensioned to match the aperture of the bar, such that the shaft can be freely removed from both when the pin is moved into the targeted position. In this way, the lifeboat 14 can be easily deployed from a ship when needed.

It is therefore submitted that the instant invention has been shown and described in various embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A lifeboat launch control system comprising:

a wheel trunk disposed in a hull of a ship;

an axle box disposed in the wheel trunk;

the axle box having a bar with a pair of wheels disposed on a pair of opposite sides thereof;

a shaft extending through an aperture in the bar and outward through the wheel trunk;

the shaft having a first end and a second end with a lifeboat interface disposed therebetween;

a pin disposed on the first end of the shaft;

the aperture in the bar shaped such that when the shaft is oriented to place the pin into a targeted position, the shaft can be freely moved through the bar;

a handle disposed on the second end of the shaft.

2. The lifeboat launch control system of claim 1, further comprising a spring disposed between the lifeboat interface and the handle, the spring tensioned and configured to expand outwardly to pull the shaft and the pin through the aperture when the pin is placed into the targeted position.

3. The lifeboat launch control system of claim 1, wherein the wheel trunk comprises a pair of flexible flaps on a pair of opposing sides thereof.

4. The lifeboat launch control system of claim 1, wherein a cover is movably disposed over a top end of the wheel trunk.

5. The lifeboat launch control system of claim 1, wherein a drain is disposed at a bottom end of the wheel trunk.

6. The lifeboat launch control system of claim 1, wherein a plurality of interior surfaces of the wheel trunk are coated in anti-fouling paint.

7. The lifeboat launch control system of claim 1, further comprising at least one davit, wherein the at least one davit includes a cable in operable connection with the lifeboat.

8. The lifeboat launch control system of claim 7, wherein the at least one davit includes a bottom support arm extending therefrom.

9. The lifeboat launch control system of claim 1, wherein the lifeboat interface comprises a bumper disposed on an external surface thereof.

10. The lifeboat launch control system of claim 1, wherein the lifeboat interface comprises a hole through a sidewall of a lifeboat, wherein the hole is dimensioned to receive the shaft and pin.

* * * * *